US011087898B2

(12) United States Patent
Crichlow

(10) Patent No.: US 11,087,898 B2
(45) Date of Patent: Aug. 10, 2021

(54) DISASSEMBLY AND DISPOSAL OF MUNITION COMPONENTS

(71) Applicant: Henry Crichlow, Norman, OK (US)

(72) Inventor: Henry Crichlow, Norman, OK (US)

( * ) Notice: Subject to any disclaimer, the term of this patent is extended or adjusted under 35 U.S.C. 154(b) by 0 days.

(21) Appl. No.: 16/888,578

(22) Filed: May 29, 2020

(65) Prior Publication Data

US 2021/0057121 A1 Feb. 25, 2021

Related U.S. Application Data

(63) Continuation-in-part of application No. 16/544,207, filed on Aug. 19, 2019.

(60) Provisional application No. 62/986,725, filed on Mar. 8, 2020.

(51) Int. Cl.

| | |
|---|---|
| ***F42B 3/06*** | (2006.01) |
| ***G21F 9/24*** | (2006.01) |
| ***C06B 21/00*** | (2006.01) |
| ***A62D 3/35*** | (2007.01) |
| ***G21F 9/30*** | (2006.01) |
| ***F42B 33/06*** | (2006.01) |
| *A62D 101/06* | (2007.01) |

(52) U.S. Cl.

CPC ..... *G21F 9/24* (2013.01); *A62D 3/35* (2013.01); *C06B 21/0091* (2013.01); *F42B 33/06* (2013.01); *G21F 9/308* (2013.01); *A62D 2101/06* (2013.01)

(58) Field of Classification Search

CPC .. G21F 9/24; G21F 9/308; F42B 33/06; F42B 33/062; C06B 21/0091; A62D 3/35

See application file for complete search history.

(56) References Cited

U.S. PATENT DOCUMENTS

| | | | | |
|---|---|---|---|---|
| 5,318,382 | A | 6/1994 | Cahill | |
| 5,516,971 | A | 5/1996 | Hurley | |
| 5,538,530 | A | 7/1996 | Heaton | |
| 6,011,193 | A * | 1/2000 | Myler | A62D 3/11 588/318 |
| 8,865,961 | B2 | 10/2014 | Nzengung | |
| 9,139,486 | B2 | 9/2015 | Von Wickede | |
| 9,587,918 | B1 | 3/2017 | Burrow | |

(Continued)

FOREIGN PATENT DOCUMENTS

KR 101420167 B1 * 8/2014

*Primary Examiner* — Janine M Kreck
(74) *Attorney, Agent, or Firm* — Eric Kelly

(57) ABSTRACT

Methods for disposing of munition components may include separating propellants from heavy metal penetrators and disposing of those separated components into different types of geological formations. The initially solid form propellants may be converted into a stable liquified propellant form, by a particular disclosed process, that may be injected within salt water (injection) disposal wells, where distal portions of such salt water disposal wells may be located in a geological formation of substantially at least one salt. The separated heavy metal penetrators (with or without their associated projectile jackets) may be disposed of within human-made caverns, where such human-made caverns may be located within a deep geological formation that is often 2,000 feet or more below the Earth's surface. The heavy metal penetrators may include uranium (depleted uranium). Portions of a given munition, to be disposed of, may be radioactive.

23 Claims, 5 Drawing Sheets

(56) References Cited

U.S. PATENT DOCUMENTS

| | | | | |
|---|---|---|---|---|
| 10,514,242 | B1 | 12/2019 | Yang | |
| 2004/0158969 | A1* | 8/2004 | Ortmann | F42B 12/06 29/592 |
| 2015/0239791 | A1* | 8/2015 | Von Wickede | C06B 21/00 588/321 |

* cited by examiner

DISASSEMBLY AND DISPOSAL OF MUNITION COMPONENTS

PRIORITY NOTICE

The present application claims priority under 35 U.S.C. § 119(e) to U.S. Provisional Patent Application Ser. No. 62/986,725 filed on Mar. 8, 2020, the disclosure of which is incorporated herein by reference in its entirety.

The present patent application is a continuation-in-part (CIP) of U.S. non-provisional patent application Ser. No. 16/544,207 filed on Aug. 19, 2019, and claims priority to said U.S. non-provisional patent application under 35 U.S.C. § 120. The above-identified patent application is incorporated herein by reference in its entirety as if fully set forth below.

TECHNICAL FIELD OF THE INVENTION

The present invention relates in general to disassembly of munitions for disposal and more specifically to" (a) physical disassembling of the munitions into various components; (b) recovery and liquification of propellant materials of the munitions; (c) the disposal of these liquid propellant materials; and (d) the disposal of the disassembled projectiles and/or the discrete kinetic elements of the munitions.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Today (circa 2020) there is a massive quantity of depleted uranium based (as well as non-uranium based) munitions and derivative waste products accumulating across the world.

For example, a recent (2019) request for services to dispose of depleted uranium munitions in the U.S. requested a contract for the disposal of 35 million (35,000,000) rounds of depleted uranium munitions.

Currently disposal of heavy metal munitions and/or munitions containing depleted uranium products, such as, but not limited to, penetrators is difficult, environmentally unsafe and publicly criticized. The depleted uranium products, though not as radioactive as uranium from nuclear energy waste projects, still remains dangerously toxic to human health and/or the general ecosphere for several millions of years. Millions of rounds of these depleted uranium products have been manufactured and several hundred thousand have been utilized in recent wars and/or armed conflicts around the globe. The fragmented and solid residues from the armed warfare use of depleted uranium munitions and/or the like, have left dangerous radioactive products on the Earth's surface in some European conflict areas and in some of the Middle East's theatres of war and/or conflict regions.

Attempts to dispose of these munitions in lined surface "pits" have been routinely and completely disallowed by state DEQ (Department of Environmental Quality or the like) agencies across the U.S. A better means of disposal is necessary.

Many existing practices for the attempted storage and/or disposal of such munitions are dangerous, produce toxic byproducts, and require the munitions' materials to be moved to safe locations, and then stored for many years before such munitions' materials can be dispose of. Some processes like ocean dumping are illegal under treaty.

Further, an important sub-process in the disposal of these munitions is the treatment of the energetic propellants, principally nitrocellulose. Several suggested means for treatment of propellants are: (a) thermal methods, these include burning, detonation, oxidation, and induction plasma; (b) biological treatment methods, these include aqueous bioreactors, compositing, and fertilizer preparation; (c) chemical treatment methods, these include activated carbon, solvent extraction, fuel supplementation, caustic hydrolysis, molten salt, electrochemical oxidation, and hydrothermal processes.

As discussed fully later in this application, the caustic hydrolysis method of disposal of the propellants may be utilized, at least in part, in some embodiments of the present invention. Caustic hydrolysis may require a least amount of personnel; caustic hydrolysis can be accomplished using industrial type chemical reactor equipment; caustic hydrolysis can be performed at comparatively lower economic costs; caustic hydrolysis has the least negative environmental effects, wherein end products of the caustic hydrolysis process is a liquid product that some embodiments of the present invention may utilize in a novel manner of disposal. These features are detailed further in the embodiments of this patent application.

There is a long felt, but currently unmet, need for safe methods that would allow the munition components which exist in a variety of physical forms and sizes to be disassembled and disposed of very deep within the Earth's crust and/or other geologic formations below the Earth's surface.

To solve the above-described problems, the present invention provides methods to disassemble and safely dispose of components of depleted uranium munitions that have been accumulating on the Earth's surface (and/or near the Earth's surface).

It is a requirement of this invention that the disassembled materials be sequestered in large enough volumes and at a considerable enough distance below the surface of the earth to maintain the highest level of human safety as possible.

A need, therefore, exists for a new method for to safely dispose of components of these munitions in a controlled manner and then depositing these dissembled (i.e., modified) products via method(s) that are designed to meet the requirements of public acceptance along with regulatory guidelines, and in a manner that is economically feasible.

It is to these ends that the present invention has been developed.

BRIEF SUMMARY OF THE INVENTION

To minimize the limitations in the prior art, and to minimize other limitations that will be apparent upon reading and understanding the present specification, at least some embodiments of the present invention may describe and define methods for the disassembly and long-term (over thousands of years) disposal/storage of munitions' components in: (a) salt-water disposal systems in deep geological formations; and/or (b) in human-made caverns in deep geological formations.

For example, and without limiting the scope of the present invention, some embodiments of the present invention may relate to process(es)/method(s) for the disassembly and subsequent disposal (storage) of depleted uranium or other type munitions by: (a) separating the explosive propellant portion(s) of the munitions from the projectiles portions; (b) processing by digesting, liquifying, stabilizing, diluting, and/or treating the propellant material to arrive at a liquified form of the propellant material (referred to as "liquified product") and then disposing of the treated liquified product into saltwater injection disposal wells, wherein the saltwater injection disposal wells are located within massive geological formations; (c) protectively disposing of the heavy metal and/or uranium containing projectiles in a large human-made cavern(s), in addition, fixing these heavy metal and/or uranium containing projectiles waste materials in specialized protective media environments, within the given human-made cavern(s), implemented in deep geological basin (formation); and (d) sealing these deep human-made cavern(s) with the emplaced munitions' components to prevent migration and contamination of the outside environment.

It is an objective of the present invention to provide disposal method(s) for the long-term disposal of munitions.

It is another objective of the present invention to provide such disposal method(s) that are effective, e.g., effective at preventing migration and/or contamination.

It is another objective of the present invention to provide such disposal method(s) that are relatively safe for operating personnel.

It is another objective of the present invention to provide such disposal method(s) that are relatively safe to surrounding communities and/or the surrounding environment/ecosphere.

It is another objective of the present invention to provide such disposal method(s) that are relatively cost effective compared to prior art methods.

It is another objective of the present invention to provide such disposal method(s) that utilize disassembly of the munitions into at least propellant materials and into heavy metal and/or uranium containing penetrators components.

It is another objective of the present invention to liquify propellant materials of the munitions.

It is another objective of the present invention to dispose of the liquefied propellant materials into saltwater injection disposal wells, wherein the saltwater injection disposal wells are located within massive geological formations.

It is another objective of the present invention to form human-made cavern(s).

It is another objective of the present invention to locate the human-made cavern(s) within deep geological formations.

It is another objective of the present invention to dispose of the heavy metal and/or uranium containing projectiles (and/or penetrators) within the human-made cavern(s).

It is another objective of the present invention to immerse the heavy metal and/or uranium containing projectiles (and/or penetrators) within a protective medium, wherein the combination of protective medium and the heavy metal and/or uranium containing projectiles (and/or penetrators) are both located within the human-made cavern(s).

It is yet another objective of the present invention to seal off these deep human-made cavern(s) with the emplaced munitions' components (and/or with the protective medium), to prevent migration and contamination of the outside environment.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

REFERENCE NUMERAL SCHEDULE

Figure 1A:
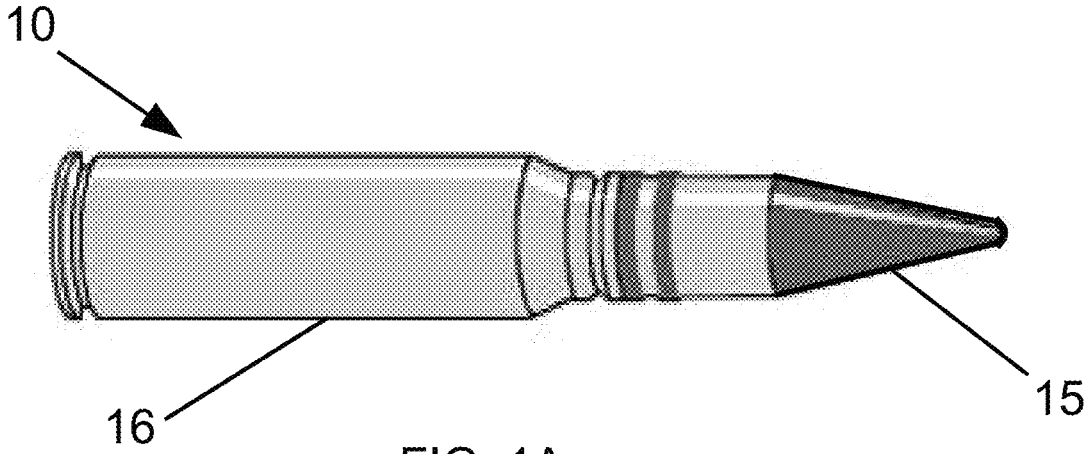
FIG. 1A may illustrate an example of a military munition (shell/round) in common use with depleted uranium material.

With regard to the reference numerals used, the following numbering is used throughout the various drawing figures.

10 munition (or shell or round) 10
11 cutting plane (on/of munition) 11
12 water spray system 12
12*a* water spray 12*a*
13 heavy metal penetrator 13
14 propellant material 14
14*a* liquified product 14*a*
15 projectile (of munition) 15
16 casing (of munition) 16
17 liquid propellant storage on surface 17
18 injection disposal well 18
19 disposal wellbore 19
20 porous and permeable zone or formation 20
21 vertical saltwater disposal well wellbore 21
21*a* wellbore casing 21*a*
22 cement in wellbore annulus 22
23 liquid transport vehicle 23

30 human-made cavern 30
31 connecting wellbore 31
31*a* wellbore packer or plug device 31*a*
31*b* wellbore cement plug 31*b*
32 protective fluid or medium 32
32*a* blanket (above protective medium) 32*a*
33 deep geologic formation 33
34 drill rig 34
35 surface storage 35
36 surface of Earth (Earth's surface) 36
301 artificial conglomerate rock system 301
400 method of disposing of depleted uranium munition components 400
401 step of physical and mechanical separation of munition components 401
401*a* step of cutting and/or extracting projectile 401*a*
401*b* step of utilizing liquid spray in separation process 401*b*
401*c* step of collecting aqueous effluent 401*c*
402 step of extracting propellant material from munition 402
402*a* step of liquefying propellant material 402*a*
402*b* step of processing and stabilizing the liquified propellant material 402*b*
402*c* step of transporting treated propellant liquid material to salt-water disposal site 402*c*
403 step of injecting liquified and treated propellant material into salt-water disposal well 403
404 step of transporting and disposing munition projectiles in human-made cavern 404
405 step of immobilizing projectiles with protective medium 405
406 step of sealing human-made cavern and its wellbore 406
407 step of marking the sealed wellbore at the surface 407
411 step of collecting munitions at a given site 411

DETAILED DESCRIPTION OF THE INVENTION

Component/item/element/part/structural names used herein, typically associated with a given reference numeral, are intended to imply and/or suggest a structure and/or function by that name.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized and changes may be made without departing from the scope of the invention.

Figure 1B:
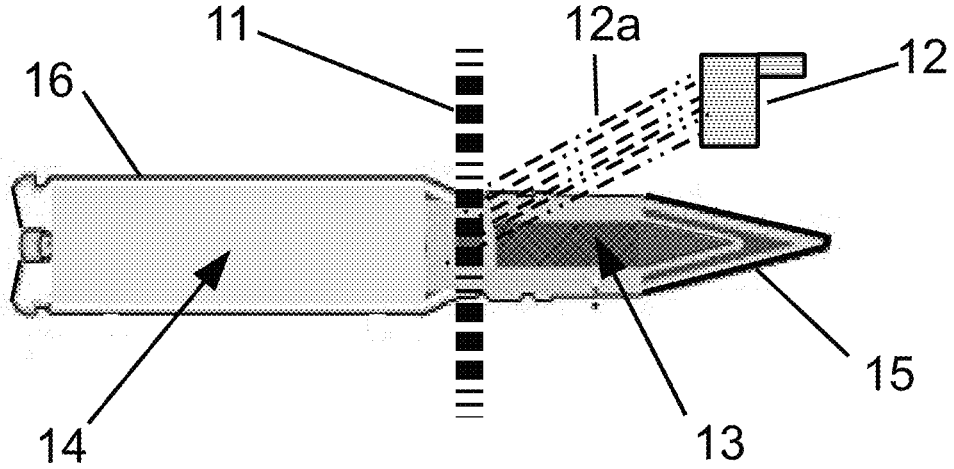
FIG. 1B may illustrate a lengthwise cross-sectional overview of a munition and of a mechanical separation process whereby a projectile front-end of the munition may be separated from its casing and propellant backend.
Figure 1C:
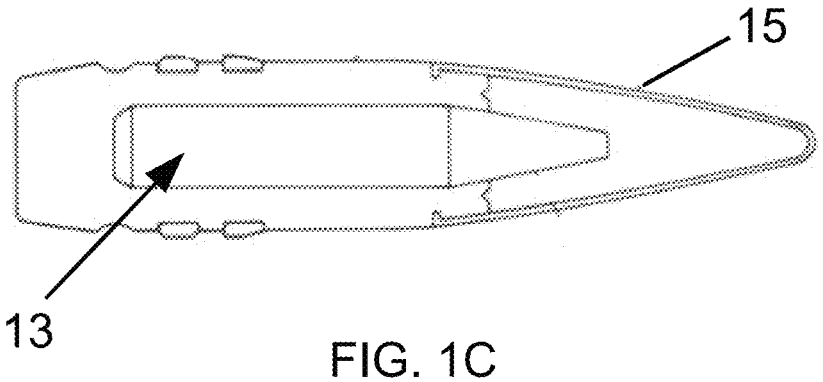
FIG. 1C may illustrate a lengthwise cross-section of a projectile portion of a munition showing at least some parts of the projectile portion.

FIGS. 1A, 1B, and 1C may illustrate external views and internal lengthwise cross-sections of munitions 10 and/or portions thereof, in use today and/or used in recent history. In some embodiments, these munitions 10 may comprise uranium, depleted uranium, heavy metal(s), combinations thereof, and/or the like. At least some embodiments of the present invention may utilize and/or operate on such munitions 10 and/or their component parts thereof.

FIG. 1A may show a typical munition 10. An outer casing 16 of munition 10 contains and houses major components of munition 10, such as, but not limited to, propellant 14 and a projectile 15, wherein propellant 14 and projectile 15 may be shown in FIG. 1B. Projectile 15 is a kinetic and destructive element which is expelled by the explosive reaction of the triggered propellant 14. The propellant 14 may be one or more chemical explosives. The propellant 14 is usually composed of chemical compounds such as, but not limited to: nitramines, nitrate esters, nitroaromatics, and the like. FIG. 1A is a generic form of complete munition 10 unit and in this form, the munitions 10 are usually stored in crates or supply bins in ammunition dumps and/or warehouses.

FIG. 1B may illustrate a longitudinal (lengthwise) cross-section view of the generic munition 10. At least some important components of munition 10 shown in FIG. 1B are: casing 16, propellant 14, and projectile 15. Also shown in FIG. 1B are internal structures and/or components of projectile 15, namely at least one heavy metal penetrator 13. A given heavy metal penetrator 13 may be made substantially of one or more heavy metals, such as, but not limited to, uranium, depleted uranium, combinations thereof, and/or the like. In some embodiments, heavy metal penetrator 13 may comprise at least some uranium (such as, but not limited to, depleted uranium). Penetrator 13 may provide enhanced and/or additional kinetic and/or destructive capabilities of munition 10, such as, but not limited to, being armor piercing. Uranium is radioactive and very dangerous.

FIG. 1B may also illustrate a process or part of a process, whereby projectile 15 of munition 10 may be separated from propellant material 14 of that same munition 10. This separation process may also involve separating a heavy metal penetrator 13 of that munition 10 from propellant material 14 of that same munition 10, because projectile 15 may comprise at least one heavy metal penetrator 13. In some embodiments, at least a partial disassembly of munition 10 may comprise generating and utilizing water spray 12*a* from a water spray system 12 that is directed along and/or at munition 10, specially along and/or cutting plane 11 to minimize or prevent sparks, minimize or prevent heat build-up, and/or to lubricate this separation process of separating the heavy metal penetrator 13 from the propellant material 14. In some embodiments, FIG. 1B illustrates use of a spray 12*a* of an aqueous or lubricating fluid emanating from a spray device 12, such that during this extraction process there is no tendency for, and there may be suppression of a spark or ignition source by friction to occur which would be dangerous to the separation process since combustion of the highly volatile propellant material 14 could occur in the absence of some means to remove heat and/or in the absence of some means to remove oxygen. In some embodiments, a low or no oxygen environment (e.g., inert gas blanket, nitrogen blanket, noble gas blanket, or the like) may be used when separating the heavy metal penetrator 13 from the propellant material 14 to minimize or prevent sparks and/or ignition risks.

Note in some embodiments, fluid 12*a* may be substantially aqueous based. Whereas, in other embodiments, fluid 12*a* may be substantially non-aqueous based.

This illustrated process of FIG. 1B may involve separating the projectile 15 physically from the munition 10 at and along a preselected (predetermined) generally cutting plane shown and described as cutting plane 11 in FIG. 1B. In some embodiments, cutting plane 11 may be orthogonal or substantially orthogonal with respect to a length/longitude of munition 10. In some embodiments, this cutting plane 11 is locationally (positionally) selected to ensure that all of the projectile 15 is completely "dismembered" (separated/removed) from the munition 10, while allowing the propellant material 14 to remain intact inside the casing 16.

In some embodiments, existing munitions handling equipment used as munitions "loaders" currently in the military operations and in the procurement/logistics industry, to load and unload ordinance onto military machines, planes, tanks, vehicles, etc. may be routinely and easily modified, retrofitted, and/or repurposed to allow their use in separation processes indicated by FIG. 1B wherein the heavy metal penetrator (and/or projectile 15) may be separated from propellant material 14 of a given munition 10. This separation process in some embodiments may include one or more of the following mechanical or separation processes: cutting, using some industrial cutting process; chopping via some industrial chopping process; extraction by pulling apart, via some pulling apart industrial process; using water cooling/lubricating (e.g., via water spray system 12); using cryogenic cooling; using low or no oxygen operating environment; combinations thereof, and/or the like. In some embodiments, such material handling equipment may facilitate the transport of these rounds of munitions 10 which are being separated into their component parts.

FIG. 1C may illustrate a lengthwise cross-section of a generic projectile 15 that comprises at least one heavy metal penetrator 13. Internal to projectile 15 may be at least one heavy-metal object, i.e., heavy metal penetrator 13. In use, outer sections of projectile 15 may disintegrate on impact with a target. However, heavy metal penetrator 13 because of its extremely high density (e.g., often in excess of 19.1 gm/cc) may continue to penetrate the target (or pass through the target). Heavy metal penetrator 13 may be comprises of uranium, depleted uranium, at least one heavy metal, combinations thereof, and/or the like. Heavy metal penetrator 13 may shed radioactive metal fragments as it penetrates the body of the target. These uranium metal fragments are often pyrophoric and may create a substantial hazard of explosion and radioactive contamination. The complete projectile 15, with its at least one heavy metal penetrator 13, may be disposed of by one or more embodiments taught in this patent application. In addition, in some embodiments, individually separated heavy metal penetrators 13 which have accumulated on battlefields in recent years may also be disposed of. The used or spent heavy metal penetrators 13 may be collected from the ground (and/or other resting places) and be disposed of in the same manner(s) that the current patent application teaches.

Figure 2:
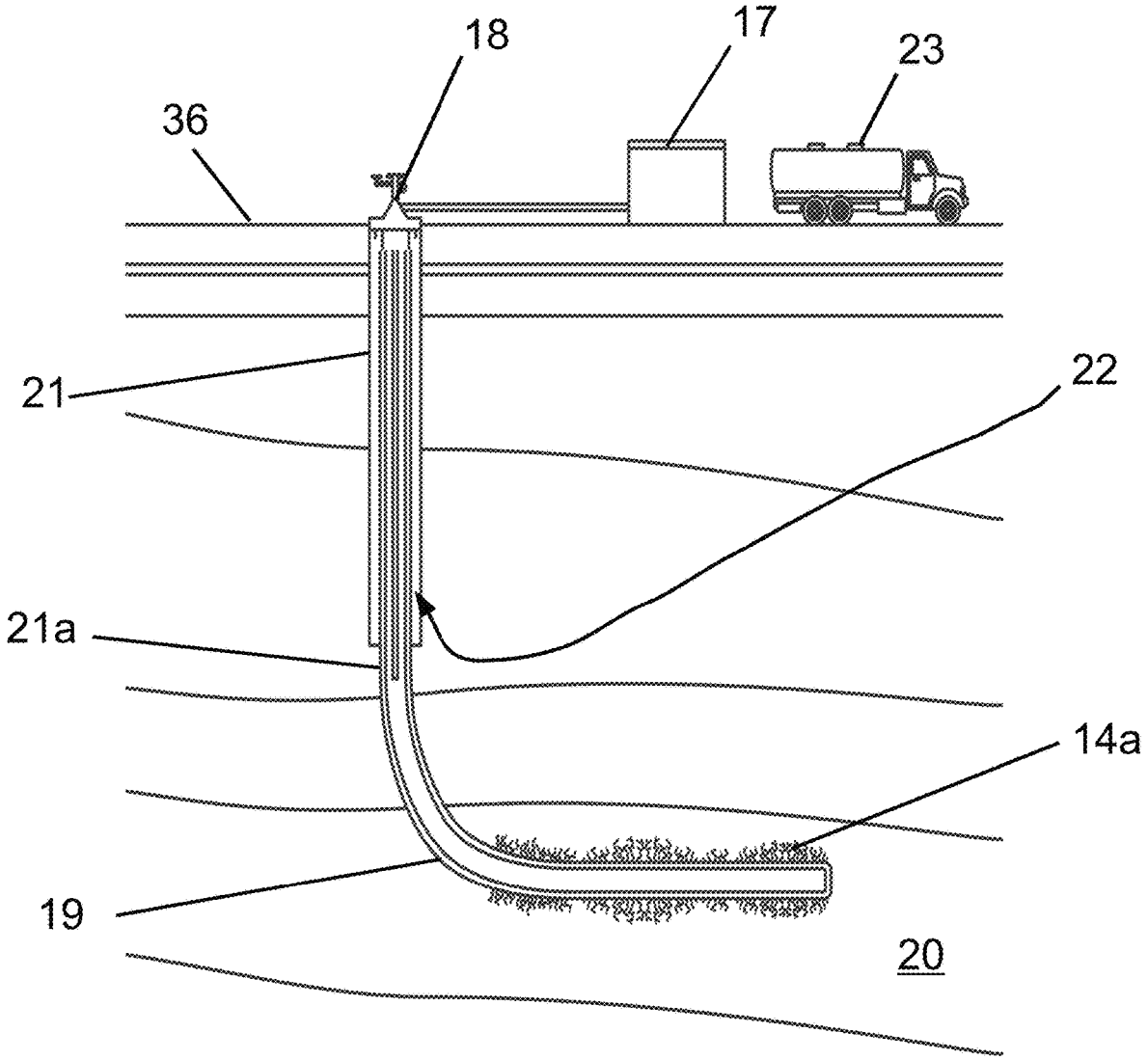
FIG. 2 may illustrate a cross-section of a saltwater disposal well and system for disposal injection of liquified munition propellant into deep formations.

FIG. 2 may illustrate a system and process utilized by at least some embodiments of this patent application. Some embodiments may modify a process that is used to dispose of saltwater produced in ongoing oil and gas producing or fracking operations. This saltwater disposal process is well-established in industry. For example, in Texas today (circa 2020) there are more than 30,000 saltwater disposal well locations. In Oklahoma there are more than 5,000 saltwater disposal well locations. It should be noted that a typical saltwater disposal well may dispose of more than 10,000 barrels or 420,000 gallons of liquid per day. This level of performance can easily accommodate all the liquid products produced in the disposal of depleted uranium munitions 10. Up till now, no one has hitherto utilized existing saltwater disposal wells for disposal of liquid products from the disassembly of the converted or treated propellant materials 14 of munitions 10. It is an objective to utilize this saltwater disposal technology to effect disposal of at least some of the depleted uranium component systems under discussion.

Note a relationship between reference numerals "14*a*" and "14" may be that reference numeral "14*a*" refers to "propellant material(s) 14" from a given munition 10 (or from many munitions 10), that has been converted, liquified, and/or treated into a substantially liquid/liquified format designed herein as "liquified product 14*a*." In some embodiments, once propellant material 14 has been converted, liquified, and/or treated into liquified product 14*a*, this liquified product 14*a*, in its now liquified state, may no longer be capable of acting as a propellant material 14; i.e., liquified product 14*a* may not be dangerous as an explosive and/or fire hazard in this liquified format. Note, as used herein liquified product 14*a* may have different states, intermediary states, and/or properties. For example, and without limiting the scope of the present invention, liquified product 14*a* may refer to one or more of: propellant material 14 being converted into a slurry and/or a solution; of being digested with at least one caustic agent (which may yield various nitrates and/or nitrites); of being pH adjusted, balanced, and/or neutralized; of receiving various additives (such as, but not limited to, for assistance with pumping); combinations thereof, and/or the like. See also FIG. 4 and its discussion below.

Discussing FIG. 2, in some embodiments, a system for disposing of liquified product 14*a* may comprise one or more of: liquid propellant storage 17 (e.g., one or more surface storage tanks), an injection disposal well 18, a vertical saltwater disposal well wellbore 21, cement 22, wellbore casing 21*a*, a disposal wellbore 19, and/or a liquid transport vehicle 23 (e.g., a truck, a tanker truck, a tanker railcar, or the like). Some of these system components may be at, above, or proximate to Earth's surface 36, such as, but not limited to, liquid propellant storage 17, injection disposal well 18, and liquid transport vehicle 23. Whereas, other components of this system may be located below and/or substantially below Earth's surface 36, such as, but not limited to, vertical saltwater disposal well wellbore 21, cement 22, wellbore casing 21*a*, and disposal wellbore 19.

Continuing discussing FIG. 2, in some embodiments, this system for disposing of liquified product 14*a* may comprise surface subsystems in which liquid transport vehicle 23 may deliver liquified product 14*a* from a remote location to liquid propellant storage 17. In some embodiments, liquid transport vehicle 23 may be configured to removably house and transport a given volume of liquified product 14*a*. In some embodiments, liquid propellant storage 17 may be configured to removably house at least some volume of liquified product 14*a* (e.g., delivered from one or more liquid transport vehicle(s) 23). In some embodiments, liquid propellant storage 17 may be located onsite (proximate) with respect to injection disposal well 18. In some embodiments, liquid propellant storage 17 may be operatively connected to injection disposal well 18, in order to facilitate transport of liquified product 14*a* from liquid propellant storage 17 to injection disposal well 18. In some embodiments, liquid propellant storage 17, injection disposal well 18, and/or liquid transport vehicle 23 may be fitted with material handling pumps to facilitate movement of liquified product 14*a*. In some embodiments, movement of liquified product 14*a* from liquid transport vehicle 23 to liquid propellant storage 17, and/or from liquid propellant storage 17 to injection disposal well 18 may be done by gravity, by pump(s), combinations thereof, and/or the like.

Continuing discussing FIG. 2, in some embodiments, injection disposal well 18 may be operatively connected to vertical saltwater disposal well wellbore 21. In some embodiments, at least a majority of vertical saltwater disposal well wellbore 21 may be located below injection disposal well 18 and below Earth's surface 36. In some embodiments, vertical salt-water disposal well wellbore 21 may be substantially orthogonal (i.e., substantially/mostly vertical) with respect to Earth's surface 36. In some embodiments, vertical saltwater disposal well wellbore 21 may be substantially parallel with a vector of the Earth's local gravitational field. In some embodiments, vertical saltwater disposal well wellbore 21 may be located within geologic formations located below Earth's surface 36.

Continuing discussing FIG. 2, in some embodiments, within at least some portions of vertical saltwater disposal well wellbore 21 may be wellbore casing 21*a* (such as, but not limited to, steel pipes). In some embodiments, wellbore casing 21*a* may line at least some interior portions of vertical saltwater disposal well wellbore 21. In some embodiments, wellbore casing 21*a* may be substantially constructed of steel; whereas, in other embodiments, wellbore casing 21*a* may be substantially constructed from other materials. In some embodiments, wellbore casing 21*a* may protect an integrity of vertical saltwater disposal well wellbore 21 and/or may help to protect geologic formations that may surround vertical saltwater disposal well wellbore 21.

Continuing discussing FIG. 2, in some embodiments, cement 22 may substantially fill annular void spaces between wellbore casing 21*a* and vertical saltwater disposal well wellbore 21. In some embodiments, cement 22 may reinforce structural integrity of wellbore casing 21*a* and/or vertical saltwater disposal well wellbore 21, which in turn may further protect the geologic formations that may surround vertical saltwater disposal well wellbore 21.

Continuing discussing FIG. 2, in some embodiments, a distal portion of vertical salt-water disposal well wellbore 21, with respect to Earth's surface 36, may transition into disposal wellbore 19. In some embodiments, vertical saltwater disposal well wellbore 21 may be operatively connected to disposal wellbore 19, such that liquified product 14*a* moving within vertical saltwater disposal well wellbore 21 may also move within disposal wellbore 19. In some embodiments, a majority of disposal wellbore 19 may be substantially orthogonal (e.g., horizontal/lateral) with respect to a majority of vertical saltwater disposal well wellbore 21. In some embodiments, a majority of disposal wellbore 19 may be substantially parallel with Earth's surface 36. In some embodiments, a majority of disposal wellbore 19 may be substantially orthogonal with respect to a vector of the Earth's local gravitational field. In some embodiments, a majority of disposal wellbore 19 may be located within a particular geologic formation, herein designated as "porous and permeable zone or formation 20." Disposal wellbore 19 may utilize inherent advantages of the lateral/horizontal wellbore configuration to dispose of liquified product 14*a* more efficiently because of the larger contact of the fluid (e.g., liquified product 14*a*) in the disposal porous and permeable zone or formation 20 as opposed to the vertical wellbore 21 which just generally contacts only the vertical height of the porous and permeable zone or formation 20 or less. In some embodiments, porous and permeable zone or formation 20 may be a particular and predetermined type of geological formation/zone. In some embodiments, porous and permeable zone or formation 20 may be located deep under Earth's surface 36, far below potable water zones and structurally and hydraulically unconnected to other zones that may eventually allow migration to or near the Earth's surface 36. In some embodiments, porous and permeable zone or formation 20 may be substantially porous and/or permeable. In some embodiments, porous and permeable zone or formation 20 may be selected from one or more of sandstone, shale, combinations thereof, and/or the like. In some embodiments, porous and permeable zone or formation 20 may not be substantially comprised of salts, aside from salts that may be injected into disposal wellbore 19 and that may then permeate into porous and permeable zone or formation 20. In general, porous and permeable zone or formation 20 may be usually only tens of feet high but these porous and permeable zone or formation 20 may extend for miles laterally/horizontally. Lateral wellbores, routinely extend up to 10,000 feet long today (2020). In some embodiments, such as disposal wellbore 19 may extend up to 10,000 feet within porous and permeable zone or formation 20.

Continuing discussing FIG. 2, in some embodiments, during the disposal process for liquified product 14*a*, liquified product 14*a* is transported by liquid transport vehicle 23 (or other means) to the injection well 18 disposal site, wherein at least some of the transported liquified product 14*a* may be removably stored in liquid surface storage 17 (e.g., surface tank(s)); and wherein at least some liquified product 14*a* may then be injected (by gravity and/or pump) into the wellhead injection disposal well 18, into vertical saltwater disposal well wellbore 21, and finally within disposal wellbore 19, wherein disposal wellbore 19 may be located within porous and permeable zone or formation 20.

Continuing discussing FIG. 2, in some embodiments, one or more of: liquid surface storage 17, injection disposal well 18, vertical saltwater disposal well wellbore 21, wellbore casing 21*a*, cement 22, and/or disposal wellbore 19 may be constructed, generated, formed, implemented, combinations thereof, and/or the like using preexisting well drilling equipment, processes, and procedures, such as, but not limited to, those used in oil field operations, fracking operations, saltwater disposal operations, combinations thereof, and/or the like. In some embodiments, a mostly horizontal portion of disposal wellbore 19 may comprise a perforated casing section from which the liquified product 14*a* may flow from the perforated casing section of disposal wellbore 19 and into the porous and permeable zone or formation 20. In some embodiments, disposed liquified product 14*a* may be rapidly absorbed into portions/regions of the proximate porous and permeable zone or formation 20 through the perforated sections of the steel casing of disposal wellbore 19.

Note, in some embodiments, heavy metal penetrator(s) 13 are not disposed of within disposal wellbore(s) 19 located within porous and permeable zone or formation 20.

Figure 3:
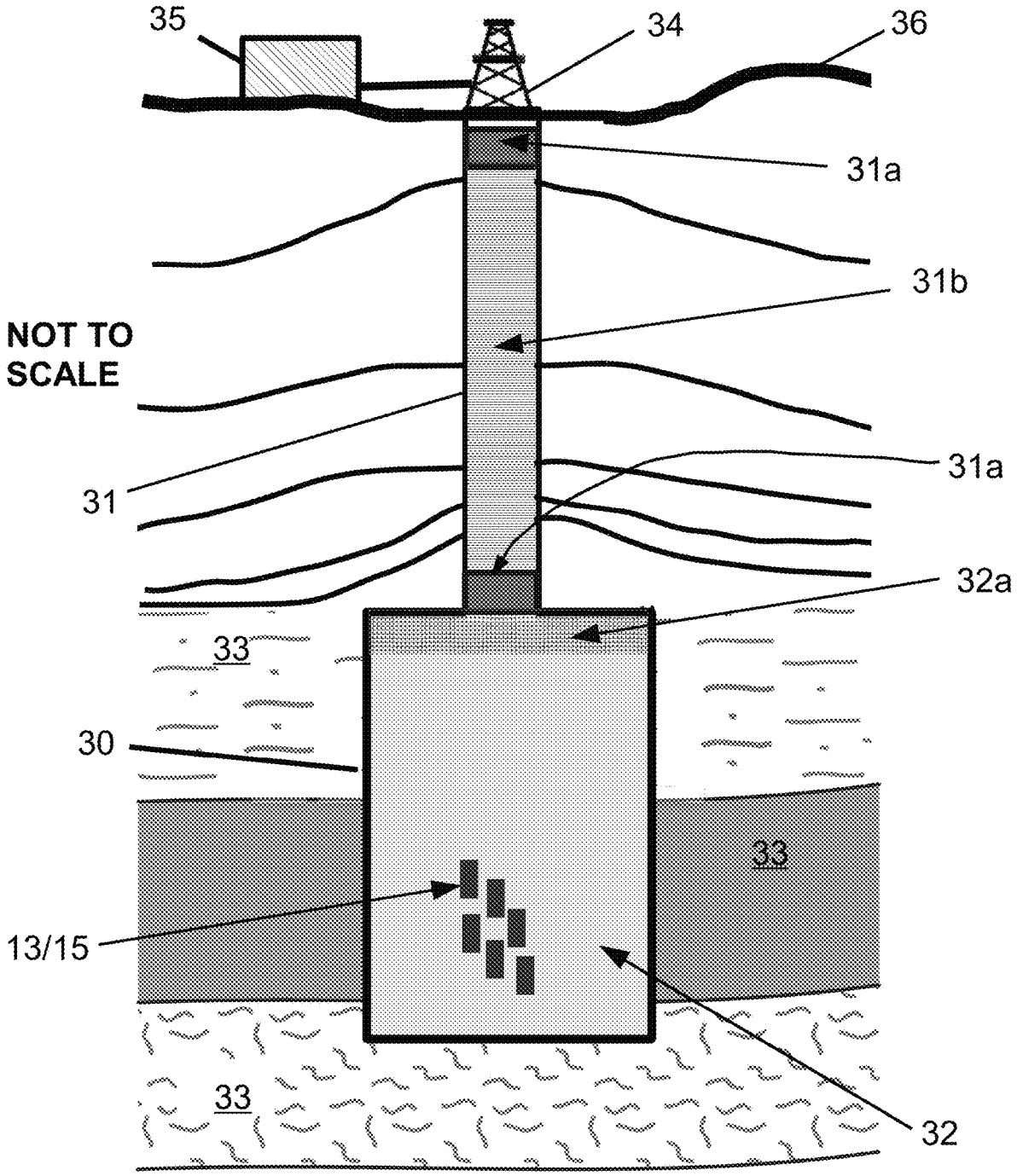
FIG. 3 may depict a generalized cross-sectional overview of selected elements included in the invention related to deep human-made cavern(s). Elements shown are on the surface, in the wellbore section(s), and within the deep underground human-made cavern section with depleted uranium material therein.

FIG. 2 depicted a system and/or a method for disposing of the propellant materials 14 once they are liquified (i.e., that of liquified product 14*a*); whereas, in contrast, FIG. 3 may depict a system and/or a method for disposing of the heavy metal penetrators 13 (projectiles 15). Note, porous and permeable zone or formation 20 of FIG. 2 is a completely different type of geologic formation (with different properties and/or characteristics) as compared to deep geologic formation 33 of FIG. 3.

FIG. 3 may illustrate an embodiment of a general overview of a deep geologic hazardous waste disposal system and/or process implemented in at least one deep human-made cavern 30. This system shown in FIG. 3 may be an integral part of at least some embodiments taught in this patent application. It is important that a means be implemented wherein the hazardous waste component of the depleted uranium of heavy metal penetrators 13 materials be safely disposed of in non-surface locations. Collection and storage of the heavy metal penetrators 13 is only a starting point in some embodiments. Some embodiments may utilize at least one human-made cavern 30 as a final disposal location for heavy metal penetrators 13. It is an objective to utilize at least one human-made cavern 30 as a deep geologic repository for the long-term disposal of depleted uranium waste materials, such as heavy metal penetrators 13.

FIG. 3 may be a schematic (cross-sectional side view) showing an overview of contemplated inventive means, systems, mechanisms, and/or methods for the storage and/or disposal of depleted uranium heavy metal penetrator 13, of radioactive material, within at least one human-made subterranean cavern 30 within at least one deep geological formation 33. In some embodiments, the disposal system and/or method shown in FIG. 3 may comprise one or more of: drill rig 34, surface storage 35, connecting wellbore 31, packer or plug device 31*a*, plug 31*b*, human-made cavern 30, heavy metal penetrator 13, projectile 15, protective medium 32, and/or blanket 32*a*. Some of these system components may be at, above, or proximate to Earth's surface 36, such as, but not limited to, drill rig(s) 34 and/or surface storage 35. Whereas, other components of this system may be located below and/or substantially below Earth's surface 36, such as, but not limited to, connecting wellbore(s) 31, packer(s) or plug device(s) 31*a*, plug(s) 31*b*, human-made cavern(s) 30. Some system components may be initially at or on Earth's surface 36, but may eventually be located below and/or substantially below Earth's surface 36, such as, but not limited to, heavy metal penetrator(s) 13, projectile(s) 15, protective medium 32, and/or blanket 32*a*.

Continuing discussing FIG. 3, in some embodiments, drilling rig 34 may be used, at least in part, to form connecting wellbore 31 and/or to from at least one human-made cavern 30 within a given deep geological formation 33. In some embodiments, drilling rig 34 may be located at, on, and/or proximate to Earth's surface 36. In some embodiments, drilling rig 34 may be substantially similar to a drilling rig used in oil field operations. In some embodiments, drilling rig 34 may be used, at least in part, for delivering (inserting and/or injecting) heavy metal penetrators 13 and/or projectiles 15 into connecting wellbore 31 for a final disposal location within at least one human-made cavern 30. In some embodiments, drilling rig 34 may be used, at least in part, for injecting (inserting) protective fluid or medium 32 around heavy metal penetrators 13 and/or projectiles 15 within a given human-made cavern 30. In some embodiments, drilling rig 34 may be used, at least in part, for injecting (inserting) a blanket 32*a* into a given human-made cavern 30, wherein this blanket 32*a* may reside above a conglomerate of heavy metal penetrators 13 and/or projectiles 15 dispersed (suspended) within protective fluid or medium 32. In some embodiments, drilling rig 34 may be used, at least in part, for implementing one or more packer(s) or plug device(s) 31*a* within at least some portion of connecting wellbore 31. In some embodiments, drilling rig 34 may be used, at least in part, for implementing one or more plug(s) 31*b* within at least some portion of connecting wellbore 31. In some embodiments, drilling rig 34 may be operatively connected to connecting wellbore 31. In some embodiments, drilling rig 34 may be operatively connected to one or more surface storages 35.

Continuing discussing FIG. 3, in some embodiments, at least one surface storage 35 may be located onsite (proximate) with drilling rig 34. In some embodiments, surface storage 35 may be located on, at, proximate, and/or above Earth's surface 36. In some embodiments, surface storage 35 may be configured for temporary storage of a plurality of heavy metal penetrators 13 and/or for a plurality of projectiles 15. In some embodiments, surface storage 35 may be one or more of: a storage rack, a storage building, a storage tank, combinations thereof, and/or the like.

Continuing discussing FIG. 3, in some embodiments, connecting wellbore 31 may connect the Earth's surface 36 to a given human-made cavern 30. In some embodiments, a given connecting wellbore 31 may run from the Earth's surface 36 down into deep geological formation 33 at a distal end of that given connecting wellbore 31. In some embodiments, a majority to a portion of connecting wellbore 31 may be substantially orthogonal (e.g., vertical) with respect to Earth's surface 36. In some embodiments, a majority to a portion of connecting wellbore 31 may be substantially parallel with respect to a local gravitational field vector of the Earth. However, some portion(s) of connecting wellbore 31 may be substantially lateral/horizontal. Because deep geological formation 33 may be located about 2,000 feet to about 30,000 feet below the Earth's surface 36, plus or minus 1,000 feet, then in some embodiments, connecting wellbore 31 may have at least such a corresponding length. In some embodiments, a given connecting wellbore 31 may have a diameter from 12 inches to 30 inches, plus or minus 3 inches. In some embodiments, when a given length of connecting wellbore 31 reaches a deep geological formation 33, then a given human-made cavern 30 may be formed/implemented within the deep geological formation 33 and operatively connected to the connecting wellbore 31. In some embodiments, a given connecting wellbore 31 may terminate/end in one or more human-made cavern(s) 30.

In some embodiments, a given interior section/portion/region of connecting wellbore 31 may be further fitted with casing(s) (e.g., piping/pipes). In some embodiments, annular regions between a cased section of connecting wellbore 31 may be filled with various predetermined cement(s).

Continuing discussing FIG. 3, in some embodiments, at least one human-made cavern 30 may be located at a distal portion of a given connecting wellbore 31. In some embodiments, a given human-made cavern 30 may be formed from various under-reaming operations that essentially enlarge a diameter of distal portions of connecting wellbore 31 that are located within a given deep geological formation 33. After under-reaming formation, a given human-made cavern 30 may be substantially hollow and cylindrical in shape. In some embodiments, a given human-made cavern 30 may be formed from under reaming operations within a portion of connecting wellbore 31, wherein once the human-made cavern 30 may be, that connecting wellbore 31 may link that formed human-made cavern 30 to the Earth surface 36. In some embodiments, a given human-made cavern 30 may have a diameter from 3 feet to 6 feet, plus or minus 6 inches. In some embodiments, a given human-made cavern 30 may have a length that ensures that given human-made cavern 30 resides within its deep geological formation 33. Because a given deep geological formation 33 may have a length/depth of many thousands of feet, a given human-made cavern 30 may also have a length of many thousands of feet. In some embodiments, a given human-made cavern 30 may have a length from 500 feet to 5,000 feet, plus or minus 100 feet. In some embodiments, a given human-made cavern 30 may be configured to receive, store, and/or house one or more of: heavy metal penetrator 13, projectile 15, protective medium 32, blanket 32*a*, combinations thereof, and/or the like.

Continuing discussing FIG. 3, in some embodiments, deep geological formation 33 may have geologic properties that make storing radioactive waste materials, such as, but not limited to, heavy metal penetrators 13 and/or projectiles 15 within a given deep geological formation 33 relatively and/or desirably safe. In some embodiments, deep geological formation 33 may be one or more of: igneous, metamorphic, sedimentary type rock formations, structural combinations thereof, and/or the like. In some embodiments, a given deep geological formation 33 may be located about 2,000 feet to about 30,000 feet below the Earth's surface 36, plus or minus 1,000 feet. Because one or more human-made cavern(s) 30 may be located (disposed of) within a given deep geological formation 33, deep geological formation 33 may also be referred to as host rock 33 or host formation 33. In some embodiments, a selected host rock 33 may have desirable and/or required properties to contain radioactive waste materials, such as, but not limited to, heavy metal penetrators 13 and/or projectiles 15 over longtime intervals (e.g., on geologic time scales, such as at least several thousands of years) and may be able to minimize migration away from the human-made cavern(s) 30 with the heavy metal penetrators 13 and/or projectiles 15 located inside. For example, and without limiting the scope of the present invention, in some embodiments, deep geological formation 33 may have one or more of the following geologic and rock properties: structural closure, stratigraphically varied, low porosity, low permeability, low water saturation, reasonable clay content, combinations thereof, and/or the like. In some embodiments, it may be desirable to locate, create, form, and/or build one or more human-made cavern(s) 30 within a given deep geological formation 33. In some embodiments, at least some properties of a given deep geological formation 33 may be demonstrated by petrophysical analysis.

Continuing discussing FIG. 3, in some embodiments, depleted uranium materials (and/or radioactive materials), such as, but not limited to heavy metal penetrators 13 and/or projectiles 15 (with heavy metal penetrators 13) may be collected and transported to the wellhead site of a given connecting wellbore 31. In some embodiments, surface storage 35 may be utilized at such time for the temporary storage of heavy metal penetrators 13 and/or projectiles 15, until the are ready for internment within a given human-made cavern 30. There several means of inserting heavy metal penetrators 13 and/or projectiles 15 into a given connecting wellbore 31 from the Earth's surface 36. The insertion process in which heavy metal penetrators 13 and/or projectiles 15 are delivered to or "landed" within a given deep geologic human-made cavern 30 may be implemented as described below. In some embodiments, insertion of heavy metal penetrators 13 and/or projectiles 15 into a given connecting wellbore 31 and ultimately into a given human-made cavern 30 that is operatively connected to the given connecting wellbore 31 may be implemented by use of "downhole tools" and/or modified downhole tools, wherein downhole tools are readily used in the oil field industry. In some embodiments, these downhole tools may be selected from one or more of: wireline operations tools; coil tubing operations tools; tubing conveyed tools; completion tools; combinations thereof, and/or the like. For example, and without limiting the scope of the present invention, oilfield engineers have been "landing" pumps, packers, valves, bottom hole assemblies, logging tools and a variety of downhole devices in vertical and lateral wellbores for decades.

In some embodiments, thousands of heavy metal penetrators 13 and/or projectiles 15 may be safely loaded/landed into a given human-made cavern 30 via its connecting wellbore 31. For example, and without limiting the scope of the present invention, a generic projectile 15 as shown in FIG. 1C may be about 4 inches long and with a 30 mm (millimeter) diameter. For example, and without limiting the scope of the present invention, a complete generic projectile 15 as shown in FIG. 1C may weigh about 400 grams; wherein the depleted uranium kinetic metal internal portion of heavy metal penetrator 13 may weigh about 300 grams. An approximate volume of that generic projectile 15 may be estimated/approximated by treating that generic projectile 15 as a right circular cylinder that is about 4 inches long and 1.2 inches in diameter. This provides an approximate volume of 5 cubic inches required for the storage of a single projectile 15. On this basis, a given human-made cavern 30 (also substantially a right circular cylinder) that is 3,000 feet tall (length) with a diameter of 60 inches has a volume of approximately 60,000 cubic feet. Drilling and reaming out a given human-made cavern 30 of this size (i.e., 3,000 feet in length by 60 inches in diameter) is a currently technically feasible task in the current drilling industry today (2020). In a 60,000 cubic foot volume of a given human-made cavern 30, assuming a packed volume of waste projectile 15 is estimated at 50%, i.e., 50% of the void space remains unfilled by waste projectiles 15 because of physical packing of the material waste projectiles 15, the calculated number of waste projectiles 15 that can be stored within the human-made cavern 30 of 60,000 cubic feet is calculated from that human-made cavern 30 volume as follows:

(cavern cubic feet)times(cubic inches per cubic foot) divided by(projectile 15 volume)=(60,000 cavern cubic feet)×(1,728 cubic inches per cubic foot)/(5 cubic inches)=20,736,000 waste projectiles 15.

That is, a human-made cavern 30 that is about 60,000 cubic feet in volume may conservatively dispose of (house) over 20 million waste projectiles 15, when a given projectile 15 has a volume of about 5 cubic inches or less.

In some embodiments, millions of heavy metal penetrators 13 and/or projectiles 15 may be safely disposed of in a given human-made cavern 30. In some embodiments, millions of heavy metal penetrators 13 and/or projectiles 15 may be safely disposed of in a small plurality of human-made caverns 30, such as, but not limited to a quantity of ten human-made caverns 30.

Continuing discussing FIG. 3, in some embodiments, after loading/landing a given quantity of heavy metal penetrators 13 and/or projectiles 15 within a given human-made cavern 30, a protective medium 32 may be pumped into that given human-made cavern 30 from the Earth's surface 36 to completely surround, immerse, and/or cover over the heavy metal penetrators 13 and/or the projectiles 15 disposed of within that given human-made cavern 30. In some embodiments, this protective medium 32 may provide for immobilization of the heavy metal penetrators 13 and/or the projectiles 15 disposed of within that given human-made cavern 30. In some embodiments, this protective medium 32 may provide for long lasting protection of the heavy metal penetrators 13 and/or the projectiles 15 disposed of within that given human-made cavern 30. In some embodiments, this protective medium 32 may, once implemented in and around the heavy metal penetrators 13 and/or the projectiles 15 disposed of within that given human-made cavern 30, further limit migration of any radioactive materials away from the heavy metal penetrators 13 and/or the projectiles 15 disposed of within that given human-made cavern 30 and into the deep geological formation 33. In some embodiments, protective medium 32 may selected from one or more of: cement, pozzolans, nanosilicas, drilling mud, bentonite, vermiculite media, carbon nanotubes, other predetermined types of protective chemicals and compounds, combinations thereof, and/or the like. In some embodiments, protective medium 32 may be a predetermined and specially formulated cement. In some embodiments, this cement may be functionally designed for high strength, low porosity, low permeability, combinations thereof, and/or the like.

In the cement industry today, pozzolans are a broad class of siliceous or siliceous and aluminous materials which, in themselves, possess little or no cementitious value but can react chemically with other chemical compounds to form compounds possessing cementitious properties.

Nanosilicas are pozzolanic and as extremely fine silica compounds have been used for years in cements. Because of its extremely fine nature and high reactivity pozzolanic material, nanosilica has been used to decrease cement permeability and porosity.

It is an objective of this invention to utilize this property of pozzolan modified media to provide long term security in disposing of the depleted uranium projectile materials, such as, but not limited to, heavy metal penetrators 13 and/or projectiles 15, by providing an immersive and protective medium 32 which mitigates the migration of the disposed of heavy metal penetrators 13 and/or projectiles 15 or their derivative/decay products away from the disposal site within the given deep human-made cavern(s) 30. It may be contemplated that the cement slurries used in some embodiments, e.g., as a given protective medium 32, may be modified by the inclusion of one or more nanosilicas. In practice, the inclusion of very fine silica particles, i.e., the nanosilicas in the cement matrix, have been shown to decrease porosity by more than 33% and permeability by up to 99%. In some embodiments, it may be contemplated that between 0.5% and 1.0% of nanosilica by weight, may be added to the specialized cement slurry formation for use in the creation of the protective medium 32 which is injected around the disposed of heavy metal penetrators 13 and/or projectiles 15 in the given human-made cavern 30. In some embodiments, the inventive approach taught herein, injects the cement slurry (protective medium 32) into the human-made cavern 30, via connecting wellbore 31, to fill in the pore spaces (void spaces) between the heavy metal penetrators 13 and/or projectiles 15 located therein, and to fill in, at least some, that human-made cavern's 30 free spaces.

Figure 3A:
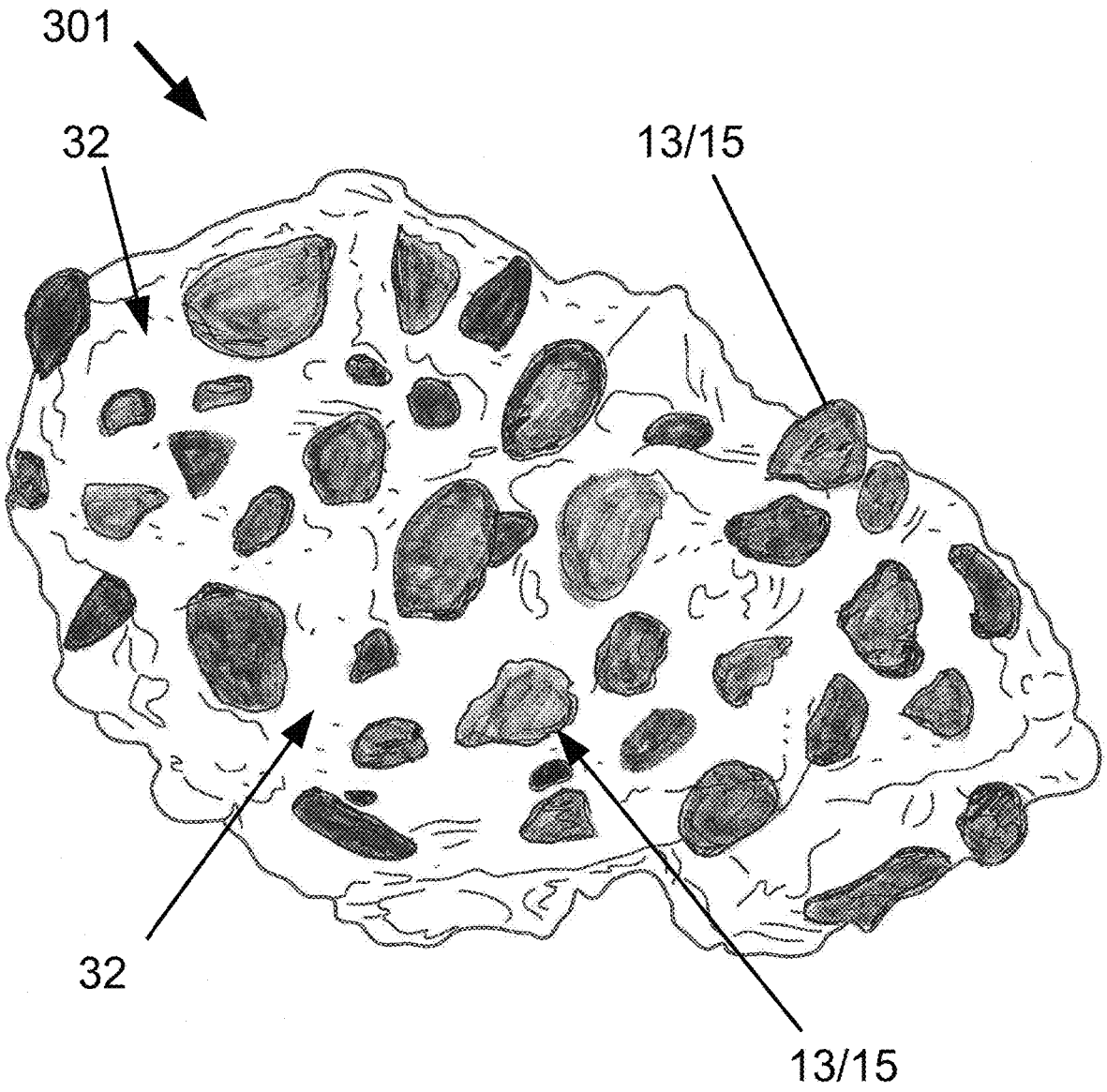
FIG. 3A may illustrate a conglomerate mass showing solid munitions components (possibly with depleted uranium and/or other heavy metals) embedded in a protective medium or matrix.

In some embodiments, upon curing, the injected cement protective medium 32 may create an artificial conglomerate rock system 301 which fixes the heavy metal penetrators 13 and/or projectiles 15 firmly in place. This newly created conglomerate rock system may be substantially solid, mostly impermeable, and with very little porosity as discussed earlier. Whatever little porosity may exist may be mostly in un-connected pore spaces. This lack of pore space communication limits transport of radionuclides, which in turn means that no or very little continuous flow of radionuclides may occur across this newly formed conglomerate rock system. A sample drawing of a rendition of this artificial conglomerate rock system 301 is shown in FIG. 3A.

Continuing discussing FIG. 3, in some embodiments, after the protective medium 32 has set in place around the disposed materials of the heavy metal penetrators 13 and/or projectiles 15, an impermeable blanket layer 32*a* of a thick long-lasting hydrocarbon, for example, bitumen or tar or some similar heavy fluid combination, may be employed above the artificial conglomerate rock system 301. In some embodiments, blanket layer 32*a* may be selected from one or more of: tar, bitumen, extremely low gravity oil, heavy crude oil, synthetic hydrocarbons, combinations thereof, and/or the like. In some embodiments, blanket layer 32*a* may an extremely low gravity, such as, 10 degree API gravity or less. In some embodiments, blanket layer 32*a* may be a gas. In some embodiments, the inclusion of this impermeable blanket layer 32*a* may provide an additional migration-limiting barrier above the encapsulated disposal materials of the heavy metal penetrators 13 and/or projectiles 15 in that given human-made cavern 30. In some embodiments, this blanket layer 32*a* may be from about 5 feet to about 10 feet thick (long), plus or minus one foot. Geological layers of tar or bitumen have been routinely found around the world, in subterranean formations acting as fluid barriers.

Continuing discussing FIG. 3, in some embodiments, one or more downhole packer(s) or plug(s) 31*a* may be strategically placed in a (predetermined) portion of connecting wellbore 31. In some embodiments, a wellbore packer or plug 31*a* may be located where the given connecting wellbore 31 joins a given human-made cavern 30 (e.g., at an entrance to that given human-made cavern 30). In some embodiments, a wellbore packer or plug 31*a* may be located at an entry the given connecting wellbore 31 at or proximate to the Earth's surface 36.

A packer may be a device, well known in the oilfields industry, that may be run into a wellbore with a smaller initial outside diameter, then the packer device may be expanded externally to seal the given wellbore. Packers may employ flexible, elastomeric elements that expand. The expansion of the packer may be accomplished by squeezing the elastomeric elements (somewhat doughnut shaped) between two plates, forcing the sides to bulge outward. Packers may be run or landed on wireline, using pipe or by using coiled tubing. Some packers are designed to be removable, while others are permanent. Permanent packers are constructed of materials that are easy to drill or mill out at a later date if removal of the packer is desired. Packers of the oilfield industry are incorporated by reference and are well understood by those of ordinary skill in the relevant arts.

Continuing discussing FIG. 3, in some embodiments, at least some portion of connecting wellbore 31 may be filled with a plug 31*b*. In some embodiments, plug 31*b* may be a cement plug configured to block access to and/or from connecting wellbore 31 (and any attached human-made cavern(s) 30.) In some embodiments, at least some portion of connecting wellbore 31 may be filled with a plug 31*b* when one or more of the following has occurred: the heavy metal penetrators 13 and/or the projectiles 15 have been landed/inserted into a given human-made cavern 30; protective medium 32 have been pumped into that given human-made cavern 30; protective medium 32 has cured within that given human-made cavern 30; the artificial conglomerate rock system 301 has formed within that given human-made cavern 30; blanket 32*a* has been pumped into that given human-made cavern 30 above the artificial conglomerate rock system 301; and/or the entrance to that given human-made cavern 30 has been blocked by wellbore packer or plug 31*a*. In some embodiments, once wellbore plug 31*b* may be in place in connecting wellbore 31, then a final wellbore packer or plug 31*a* at the entrance to that connecting wellbore 31. In some embodiments, one or more packers 31*a* may be utilized in sealing the connecting wellbore 31.

Note, the heavy metal penetrators 13 and/or projectiles 15 being disposed in FIG. 3 may be without propellant materials 14 and/or without liquified product 14*a*.

Continuing discussing FIG. 3, in some embodiments, one or more of: drill rig 34, surface storage 35, connecting wellbore 31, packer or plug device 31*a*, plug 31*b*, human-made cavern 30, combinations thereof, and/or the like may be constructed, generated, formed, implemented combinations thereof, and/or the like, using preexisting well drilling equipment, processes, and procedures, such as, but not limited to, those used in oil field operations.

FIG. 3A may illustrate a superficial view of a portion of a typical artificial conglomerate rock system 301 that may be formed when the waste materials, such as, but not limited to, the heavy metal penetrators 13 and/or the projectiles 15 are disposed of in a given human-made cavern 30 and also at least partially dispersed within the protective medium 32, also located within that given human-made cavern 30. In some embodiments, a given artificial conglomerate rock 301 may be comprised of the heavy metal penetrators 13 (and/or projectiles 15) and the protective medium 32. Geological studies and core samples obtained during deep oilfield drilling operations, have shown that naturally occurring rock conglomerates may remain undisturbed in place for millions of years. Inventive system and/or methods taught herein seek for generate/form artificial conglomerate rock system 301 that may be geologically stable for sufficiently long time periods (e.g., thousands of years), resulting in environmental protection and protection to human societies and civilizations.

Figure 4:
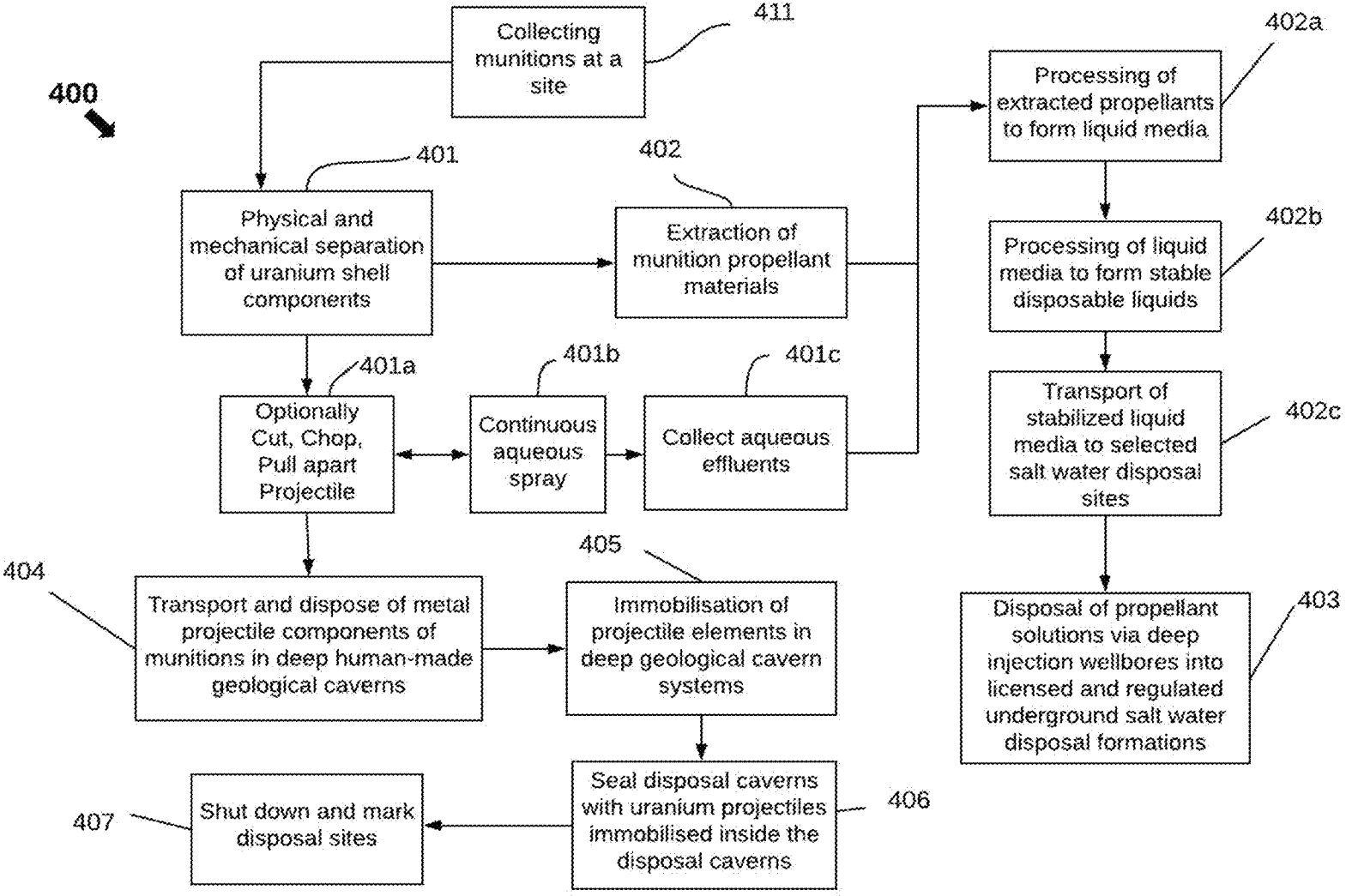
FIG. 4 may illustrate a flowchart of a method used in disposing of the depleted uranium (and/or other heavy metals) munition components.

FIG. 4 may depict a flowchart. FIG. 4 may depict method 400. FIG. 4 may depict at least some steps of method 400. In some embodiments, method 400 may a method of/for disposing munitions components. In some embodiments, method 400 may a method of/for disposing of heavy metal containing munitions. In some embodiments, method 400 may a method of/for disposing of uranium (depleted and/or otherwise) containing munitions.

In some embodiments, method 400 may be a method of physically and mechanically separating projectile 15 (e.g., with heavy metal penetrator 13) from casing 16 of munition 10 (and disposing of projectile 15 and/or heavy metal penetrator 13, in some embodiments). In some embodiments, method 400 may be a method of disposing of projectiles 15 and/or heavy metal penetrators 13 in at least one (one or more) deep human-made cavern(s) 30. In some embodiments, method 400 may further comprise injecting protective fluid or medium 32 into the given at least one human-made cavern 30 and surrounding and filling in around projectiles 15 and/or heavy metal penetrators 13 that are within that given at least one human-made cavern 30 and thereby protecting those projectiles 15 and/or heavy metal penetrators 13.

In some embodiments, method 400 may be a method of separating/extracting and processing propellant material 14 from munition 10 into liquified product 14*a* (and disposing of liquified product 14*a*, in some embodiments). In some embodiments, method 400 may be a method of further liquifying, processing and disposing of liquified product 14*a* and/or its derivatives in a (deeply located in some embodiments) given porous and permeable zone or formation 20 via a salt-water injection disposal well 18.

In some embodiments, method 400 may include a step of shutting down the disposal process in a given deep human-made cavern 30. In some embodiments, method 400 may include a step of sealing a given human-made cavern 30 and its connecting wellbore 31, by using one or more of: downhole plugs 31*a*, packers 31*a*, cement plugs 31*b*, plugging of the vertical connecting wellbore 31, using a means to safely marking a location of that connecting wellbore 31 on the Earth's surface 36, combinations thereof, and/or the like.

Continuing discussing FIG. 4, in some embodiments, method 400 may comprise at least one of the following steps: 401, 401*a*, 401*b*, 401*c*, 402, 402*a*, 402*b*, 402*c*, 403, 404, 405, 406, 407, combinations thereof, and/or the like. Not all embodiments of method 400 may comprise all these steps. Some of these steps may be optional and/or omitted in some embodiments of method 400. In some embodiments of method 400 such steps may occur out of order with respect to these step reference numerals.

Continuing discussing FIG. 4, in some embodiments, step 401 may be a step of physically and mechanically separating a projectile 15 from its munition 10. In some embodiments, step 401 may be a step of physically and mechanically separating a projectile 15 from its casing 16. In some embodiments, step 401 may be a step of physically and mechanically separating a heavy metal penetrator 13 from its munition 10. In some embodiments, step 401 may be a step of physically and mechanically separating a heavy metal penetrator 13 from its casing 16. In some embodiments, completion of step 401 may progress into step 402. In some embodiments, step 401 may be comprises of steps 401*a*, 401*b*, and 401*c*.

Continuing discussing FIG. 4, in some embodiments, step 401 may be a step of cutting, separating, and/or extracting projectile 15 from its casing 16 (from its propellant material 14). In some embodiments, step 401*a* may include one or more mechanical practices which may comprise a "cutting" process. In some embodiments, this "cutting" process may comprise cutting the munition 10 at and along a selected cutting plane 11. In some embodiments, this cutting process may comprise cutting by abrasive means or industrially accepted abrasive jetting process. In some embodiments, step 401*a* may comprise one or more mechanical practices of a "chopping" process. In some embodiments, this chopping process may comprise "chopping" munition 10 at and along cutting plane 11 by a "guillotine" (or guillotine like) chop process or industrially accepted chop process. In some embodiments, this chopping process may comprise chopping munition 10 at/along cutting plane 11. In some embodiments, this chopping process may comprise chopping by abrasive means or industrially accepted abrasive jetting process. In some embodiments, step 401*a* may comprise one or more mechanical practices of a "pull apart" process. In some embodiments, this pull apart process may comprise pulling apart projectile 15 from its casing 16, at and/or along cutting plane 11 by a "pull apart" like process or industrially accepted pull-apart process. In some embodiments, this "pull apart" process may comprise mechanically pulling projectile 15 out of its munition casing 16 or employing an industrially accepted tension pulling process. In some embodiments, step 401*a* may be optional in method 400. In some embodiments, step 401*a* may transition into step 401*b*. In some embodiments, step 401*a* may be occurring simultaneously/concurrently while step 401*b* and/or step 401*c* may also be occurring. In some embodiments, step 401*a* may transition into step 404.

Continuing discussing FIG. 4, in some embodiments, step 401*b*, may be a step of utilizing a water spray system 12 (or the like or the equivalent), that generates water spray 12*a*, directed at munition 10 at/along cutting plane 11. In some embodiments, step 401*b* may be occurring simultaneously/concurrently while step 401*a* (step 401) may also be occurring. In some embodiments, step 401*b* may help to prevent ignition, explosion, and/or excessive heating of propellant material 14 during step 401*a*. In some embodiments, step 401*b* may help to minimize ignition, explosion, and/or excessive heating of propellant material 14 during step 401*a*. In some embodiments, during the separation steps (e.g., step 401 and/or step 401*a*), wherein projectile 15 may be separated from casing 16 (from propellant material 14), a jet or a spray of fluid 12*a* may be directed at cutting plane 11 along the separation plane/region on the given munition 10. In some embodiment, this spray 12*a* or jet 12*a* may be an aqueous fluid of some non-flammable lubricant directed on the cutting plane 11 from a spray device 12 such that the fluid 12*a* or the lubricant 12*a* prevents the formation of a spark or ignition source which would potentially and disastrously detonate propellant material 14. In some embodiment, this spray 12*a* or jet 12*a* may operate continuously during step 401*a* and/or step 401*c*. In some embodiments, step 401*b* may be replaced and/or augmented by conducting step 401*a* within a controlled zero (or minimal) oxygen atmosphere that may not support sparks, ignition, combustion, and/or fire. In some embodiments, step 401*b* may be replaced and/or augmented by conducting step 401*a* within a controlled cryogenically/cooled/chilled environment. In some embodiments, step 401*b* may transition into step 401*c*. In some embodiments, step 401*b* may be occurring simultaneously/concurrently while step 401*a* and/or step 401*c* may also be occurring.

Continuing discussing FIG. 4, in some embodiments, step 401*c*, may be a step of collecting (aqueous) effluents from spray/jet 12*a* of step 401*b*. In some embodiments. Effluents from spray/jet 12*a* may be collected in one or more reservoirs intended and/or configured for that purpose. In some embodiments, step 401*c* may be occurring after step 401*b*. In some embodiments, step 401*c* may be occurring simultaneously/concurrently with step 401*b* (and/or step 401*a*). In some embodiments, completion of step 401*c* may transition method 400 into step 402 and/or into step 402*a*.

Continuing discussing FIG. 4, in some embodiments, step 402, may be a step of extracting/obtaining propellant material 14 from its munition 10 (its casing 16). In some embodiments, step 402 of method 400 may comprise extraction of propellant material 14 from its casing 16 of its munition 10. In some embodiments, a solid propellant material 14 may be removed from its casing 16 by mechanical, hydraulic jetting means, combinations thereof, and/or the like. In some embodiments, step 402 may comprise steps: 402*a*, 402*b*, and 402*c*. In some embodiments, completion of step 402 and/or completion of steps 402*a*, 402*b*, and 402*c* may transition method 400 into step 403.

Continuing discussing FIG. 4, in some embodiments, step 402*a*, may be a step of separating solid propellant material 14 from its casing 16 (e.g., via the hydraulic jetting means), into a flurry form. In some embodiments, results of step 402*a*, i.e., the slurry mixture and/or liquid form of propellant material 14 may be collected within one or more suitable containers/vessels. In some embodiments, completion of step 402*a* may transition into step 402*b*.

Continuing discussing FIG. 4, in some embodiments, step 402*b*, may be a step of treating, digesting, and/or converting product(s) of step 402*a* (such as the slurry form of the propellant material 14). In some embodiments, step 402*b* of method 400, may comprise the physical and/or chemical processing of the propellant mixture/slurry 14 from step 402*a*. The liquid effluent obtained from the propellant 14 in step 402*a* may be digested in a reactor vessel or similar industrial type digester vessel with one or more of predetermined/selected digester chemical(s). In some embodiments, caustic hydrolysis may be utilized for processing the slurry like propellant material 14 in step 402*b*. In some embodiments, step 402*b* may a single-step digestion process. In some embodiments, a single-step digestion process may be superior to other methods because of the following features: (a) chemical process effectiveness; (b) minimal safety concerns; (c) minimal costs of operations; (d) minimal environmental impact; (e) minimal regulatory concerns; combinations thereof; and/or the like. In some embodiments, a choice of caustic chemicals for use in this caustic hydrolysis process of step 402*b*, may be one or more of the following: sodium hydroxide (NaOH), calcium hydroxide Ca(OH)2, potassium hydroxide (KOH), combinations thereof, and/or the like. For example, and without limiting the scope of the present invention, a caustic alkali, such as, sodium hydroxide (NaOH) may be used as at least one digester chemical. In some embodiments, the caustic chemical, (e.g., NaOH) may contain between 3% and 25% of NaOH by weight. Note, NaOH may be relatively inexpensive, stable, and used with regularity within many industrial operations and practice.

Note, it has been well documented in the literature that nitrocellulose propellant material 14 are resistant to both aerobic and anaerobic biodegradation processes. An effective method to breakdown and/or digest the nitrocellulose propellant material 14 is needed. The embodiments taught in this patent application may provide this method and utilize a direct caustic alkali process. Quantitative studies have indicated a formation of soluble nitrites and nitrates during a caustic hydrolysis process on nitrocellulose materials. Most such data indicates that a ratio of nitrites to nitrates to be about 3.0. These industrial chemicals, such as, but not limited to, NaOH, nitrites, and/or nitrates, may be handled safely and easily in practice today.

In some embodiments, step 402*b*, the digestion process may proceed at a moderately elevated temperature from about 40 degrees Celsius (° C.) to about 95° C., plus or minus 1° C., just below the boiling point of water. The caustic digestion process may occur over a period of time up to 12 hours reaction time (plus or minus one hour in some embodiments). During the digestion process in this step 402*b*, the digester liquid may be agitated continuously or intermittently to prevent sediment/precipitate buildup, sediment/precipitate clogging, and/or to produce a complex liquor solution. Any gases produced in this process 402*b* may be filtered through filter packs and safely vented to the atmosphere. In some embodiments, the used filters (with off gas byproducts, derivatives, and/or contaminants) may be disposed of in selected landfills. In some embodiments, the caustic digestive process of step 402*b* may be continued on until at least 95% of the propellant material 14 is fully dissolved, resulting in liquified product 14*a*.

Continuing discussing step 402*b*, in some embodiments, excess or remaining slurry of the solid propellant material 14 may be recirculated and readmitted with a new batch of slurry propellant material 14 to be digested (e.g., from a step 402*a*).

Continuing discussing step 402*b*, in some embodiments, the digested liquor 14*a* (liquified product 14*a*) may be stabilized/neutralized to about a neutral pH by adding at least one type of acid. For example, and without limiting the scope of the present invention, phosphoric acid may be used to lower the pH of the liquified product 14*a* to a value between pH 7 and pH 8 (plus or minus 0.1 pH in some embodiments). In some embodiments, a pH range may be from pH 6.5 to pH 7.5 (plus or minus 0.1 pH in some embodiments). In some embodiments, a pH range may be from pH 6.5 to pH 8 (plus or minus 0.1 pH in some embodiments). This neutralization process may facilitate safety and/or economic feasibility of later steps, such as step 402*c* and/or step 403.

Continuing discussing step 402*b*, in some embodiments, a stoichiometric analysis of chemical reaction(s) between the propellant material 14 (along with its carrier and/or solvent fluid) and the caustic digester chemical (mixture) (such as, but not limited to, NaOH) may be completed to provide an optimal concentration and/or gravimetric analysis of a feed rate (or batch size) of the propellant material 14 and the required caustic digestive chemical(s) concentration and/or volume. Today (2020), this type of stoichiometric analysis may be completed in real-time, near real-time, automatically, and/or simultaneously in parallel to the ongoing operation of processing the propellant material 14, to allow the process to account for the variations in input chemical and/or physical component analyses during ongoing operations.

Continuing discussing step 402*b*, in some embodiments, completion of step 402*b* may transition method 400 into step 402*c*.

Continuing discussing FIG. 4, in some embodiments, step 402*c* may be a step of transporting the product of step 402*b*, i.e., liquified product 14*a*, to a salt water injection disposal well 18 site. In some embodiments, step 402*c* may utilize liquid transport vehicle(s) 23 to transport the product of step 402*b*, liquified product 14*a*, to the given salt water injection disposal well 18 site. In some embodiments, in step 402*c*, liquified product 14*a* from liquid transport vehicle(s) 23 may be transferred into one or more liquid propellant storage 17 (e.g., tanks 17). In some embodiments, step 402*c* may comprise collecting the liquid products (liquified product 14*a*) from step 402*b*. In some embodiments, step 402*c* may comprise adding one or more chemicals to these liquid products (liquified product 14*a*) from step 402*b* to: stabilize; prevent corrosion; prevent precipitation; maintain/facilitate pumpability of the liquified product 14*a* such that the liquified product 14*a* is fully capable of being pumped and injected into wellbores and into deep underground formations 20 without "clogging" up the pore spaces in the disposal formation 20. In some embodiments, the treated liquified product 14*a* may be diluted with water to lower the concentration in parts per million (ppm) of the final disposal fluid liquified product 14*a* to meet regulatory ppm level requirements. In some embodiments, ppm concentrations of chemicals within the final disposal fluid liquified product 14*a* may be within (below) limits set forth by various laws and/or regulatory agencies. In some embodiments, the ppm concentrations for at least one chemical in the final disposal fluid liquified product 14*a* may be at or below 10,000 ppm. In some embodiments, the ppm concentrations for at least one chemical in the final disposal fluid liquified product 14*a* may be at or below 50,000 ppm. In some embodiments, completion of step 402*c* may cause method 400 to transition into step 403.

Continuing discussing FIG. 4, in some embodiments, step 403 may be a step of injecting the fully and/or finally treated, converted, digested, stabilized, neutralized, diluted, and/or pump ready liquified product 14*a* from step 402*b* and/or 402*c* into one or more salt water injection disposal well(s) 18. See e.g., FIG. 2 and its above discussion. In some embodiments, step 403 may also comprise forming a necessary salt water injection disposal well 18. In some embodiments, salt water injection disposal well(s) 18 or the like may be licensed and/or regulated by various regulatory agencies (e.g., to meet various environmental regulations, such as, to ensure the salt water injection disposal wells maintain their integrity, such that no contamination of surface waters or near surface potable water supplies are disturbed). Today (2020) there are large numbers of saltwater disposal wells widely distributed all over the U.S. and the world in the existing oil and gas production areas. Many of such existing saltwater disposal wells could be used as a given salt water injection disposal well 18 for the disposal of the liquified product 14*a*. In some embodiments, with respect to disposal of propellant material 14, method 400 may end at step 403; however, method 400 may have other steps with respect to disposal of projectiles 15 and/or heavy metal penetrators 13.

Continuing discussing FIG. 4, in some embodiments, step 404 may be a step of transporting at least one projectile 15 and/or at least one heavy metal penetrator 13 to a given connecting wellbore 31 site (that is operatively connected to at least one human-made cavern 30). In some embodiments, step 404 may be a step of disposing of at least one projectile 15 and/or at least one heavy metal penetrator 13 within a given human-made cavern 30, wherein that given human-made cavern 30 may be located within deep geological formation 33. In some embodiments, step 404 may be a step of transporting at least one projectile 15 and/or at least one heavy metal penetrator 13 to a given connecting wellbore 31 site and of disposing of the at least one projectile 15 and/or the at least one heavy metal penetrator 13 within a given human-made cavern 30 that is operatively connected to that given connecting wellbore 31, wherein that given human-made cavern 30 may be located within deep geological formation 33. See e.g., FIG. 3 and its above discussion. In some embodiments, step 404 may be operating upon at least some of the results/products of step 401*a*, namely, projectiles 15 and/or heavy metal penetrators 13, that have been separated (detached) from propellant material 14 (casing 16). In some embodiments, step 404 may comprise transportation of the projectile components (projectiles 15 and/or heavy metal penetrators 13) collected/generated in the step 401*a*, step 401*b*, and/or step 401*c*. In some embodiments, after transportation to the site of the deep manmade cavern(s) 30, the materials (projectiles 15 and/or heavy metal penetrators 13) are inserted/injected into a given (vertical) connecting wellbore 31 and then further into at least one deep human-made cavern 30 that is operatively connected to that connecting wellbore 31. In some embodiments, in step 404 the projective materials (projectiles 15 and/or heavy metal penetrators 13) are lowered into the given connecting wellbore 31 and finally into the at least one human-made cavern 30 (that is operatively connected to that connecting wellbore 31) using oilfield tools used in the oil and gas industry today (and/or modified oilfield tools). In some embodiments, step 404 may comprise forming and/or generating necessary structures (e.g., connecting wellbore(s) 31 and/or human-made cavern(s) 30) for carrying out the disposal contemplated by step 404. In some embodiments, completion of step 404 may transition method 400 into step 405.

Continuing discussing FIG. 4, in some embodiments, step 405 may be a step of immobilizing projectiles 15 and/or heavy metal penetrators 13 that have been inserted/injected into a given human-made cavern 30 (e.g., via step 404). In some embodiments, in step 405, the projectiles 15 and/or heavy metal penetrators 13 are immobilized in place, within the given human-made cavern 30, by injecting protective fluid or medium 32 into that same human-made cavern 30. As shown and as discussed earlier in FIG. 3 and in FIG. 3A, this immobilization process firmly fixes the projectiles 15 and/or heavy metal penetrators 13 as an artificial conglomerate rock system 301 mass which minimizes any radiation contamination by the projectiles 15 and/or heavy metal penetrators 13. In some embodiments, step 405 may also entail injecting blanket 32*a* above artificial conglomerate rock system 301 within the given human-made cavern 30. In some embodiments, completion of step 405 may transition method 400 into step 406.

Continuing discussing FIG. 4, in some embodiments, step 406 may be a step of sealing off a given human-made cavern 30 and/or its connecting wellbore 31, wherein that given human-made cavern 30 (to be sealed) may comprise at least one projectile 15, at least one heavy metal penetrators 13, and/or artificial conglomerate rock system 301. In some embodiments, step 406 may comprise forming and/or placing: (a) at least one wellbore packer or plug 31*a* at a union/junction between connecting wellbore 31 and the given human-made cavern 30 with the at least one projectile 15, at least one heavy metal penetrators 13, and/or artificial conglomerate rock system 301 (see e.g., FIG. 3); (b) at least one wellbore plug 31*b* (e.g., substantially of a predetermined cement) within at least some portion/region of the given connecting wellbore 31 that is/was operatively connected to the given human-made cavern 30 with the at least one projectile 15, at least one heavy metal penetrators 13, and/or artificial conglomerate rock system 301 (see e.g., FIG. 3); (c) at least one wellbore packer or plug 31*a* at a top of the connecting wellbore 31 (e.g., at or proximate to where that connecting wellbore 31 meets Earth's surface 36) that leads to the given human-made cavern 30 with the at least one projectile 15, at least one heavy metal penetrators 13, and/or artificial conglomerate rock system 301 (see e.g., FIG. 3); combinations thereof, and/or the like. In some embodiments, in step 406, after the projectiles 15 and/or heavy metal penetrators 13 are immobilized in place by injection of the protective medium 32, that given disposal human-made cavern 30 may be sealed by one or more packer or plug devices 31*a*. In some embodiments, such packer(s) 31*a* are "landed" at the top of that given human-made cavern 30 (see e.g., FIG. 3). In some embodiments, in step 406, the (cased) (vertical) connecting wellbore 31 may be loaded with wellbore plug 31*b* (e.g., a predetermined cement) to completely or partially fill and shut off communication in that (vertical) connecting wellbore 31 (see e.g., FIG. 3). In some embodiments, plugging at or proximate to the Earth's surface 36 and the given connecting wellbore 31 may be implemented by installing a packer or plug 31*a* at a top of that given connecting wellbore 31 (see e.g., FIG. 3). In some embodiments, step 406 may utilize back filling operations (e.g., with respect to connecting wellbore 31 and/or human-made cavern 30). In some embodiments, completion of step 406 may cause method 400 to transition into step 407.

Continuing discussing FIG. 4, in some embodiments, step 407 may be a step of shutting down, marking, protecting, combinations thereof, and/or the like the connecting wellbore 31 site that has been sealed by step 406. In some embodiments, step 407 may comprise removal of substantially all surface equipment (e.g., drill rig 34) used to implement steps 404, 405, and/or 406. In some embodiments, step 407 may comprise marking the connecting wellbore 31 site that has been sealed by step 406. In some embodiments, step 407 may be a step of protecting the connecting wellbore 31 site that has been sealed by step 406. In some embodiments, such marking and/or protecting may comprise physical onsite/location marking, such as with signage, fences, walls, buildings, lights, sirens, speakers, combinations thereof, and/or the like. In some embodiments, such marking may serve a notice function (e.g., a public safety notice function). In some embodiments, such marking may minimize trespassing. In some embodiments, such marking may provide location information for a given seal connecting wellbore 31. In some embodiments, step 407 may conclude method 400 with respect to disposal of projectiles 15 and/or heavy metal penetrators 13.

In some embodiments, method 400 may comprise step 411. In some embodiments, step 411 may be a step of collecting one or more of: munitions 10, heavy metal penetrators 13, projectiles 15, casings 16, propellant materials 14, components thereof, combinations thereof, and/or the like at at least one predetermined site. In some embodiments, step 411 may occur before other steps of method 400, such as, but not limited to, step 401. In some embodiments, at least some steps, beside step 411, may occur at this predetermined site.

Note designations of first, second, third, and the like in the claims, may refer to a quantity of such elements. And/or, designations of first, second, third, and the like in the claims, may refer different elements, but of similar element type. For example, and without limiting the scope of the present invention, claim terms of "first plug" may refer to a plug 31*a* located at a top of human-made cavern 30; "first packer" may refer to a packer 31*a* located at a top of human-made cavern 30; "second plug" may refer to a plug 31*a* located where connecting wellbore 31 mates/joins human-made cavern 30; "second packer" may refer to a packer 31*a* located where connecting wellbore 31 mates/joins human-made cavern 30; "third plug" may refer to plug 31*b* within a portion/region of connecting wellbore 31; "fourth plug" may refer to a plug 31*a* located at a top of connecting wellbore 31; and/or "third packer" may refer to a packer 31*a* located at the top of connecting wellbore 31. See e.g., FIG. 3.

Methods for disassembling munitions (with depleted uranium and/or heavy metals, in some embodiments) and the subsequent disposal munitions' components have been described. The foregoing description of the various embodiments of the invention has been presented for the purposes of illustration and disclosure. It is not intended to be exhaustive or to limit the invention to the precise form disclosed. Many modifications and variations are possible in light of the above teaching without departing from the spirit of the invention.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method for disposing of at least one munition, comprising steps of:

(a) separating a heavy metal penetrator from a propellant of the at least one munition;

(b) converting the propellant into a liquified product;

(c) injecting the liquified product into at least a distal portion of an injection disposal well, wherein the distal portion is located within a geological formation comprised substantially of at least a porous and permeable zone; and (d) inserting the heavy metal penetrator into a human-made cavern, wherein the human-made cavern is located within a deep geological formation, wherein the deep geological formation is located from about 2,000 feet to about 30,000 feet below a surface of the Earth, plus or minus 1,000 feet;

wherein the geological formation and the deep geological formation are different formations.

2. The method according to claim 1, wherein prior to the step (a), the method comprises a step of collecting the at least one munition at a predetermined site.

3. The method according to claim 1, wherein the step (a) comprises one or more of: cutting along a predetermined plane of the at least one munition; chopping at the predetermined plane; or pulling apart a projectile from a casing of the at least one munition, wherein the casing comprises the propellant, wherein the projectile comprises the heavy metal penetrator.

4. The method according to claim 3, wherein the predetermined plane of the at least one munition is substantially orthogonal with respect to an overall length of the at least one munition.

5. The method according to claim 3, wherein the step (a) occurs while a jet or a spray of a fluid from a spray system is directed at the predetermined plane of the at least one munition.

6. The method according to claim 5, wherein the fluid is substantially aqueous based.

7. The method according to claim 5, wherein the fluid functions to one or more of: lubricate at the predetermine plane during the step (a); minimize heating of the propellant during the step (a); minimize igniting the propellant during the step (a); or minimize exploding the propellant during the step (a).

8. The method according to claim 1, wherein the step (b) comprises introducing a predetermined liquid to the propellant to form a slurry and extracting that slurry from a casing of the at least one munition.

9. The method according to claim 8, wherein the step (b) further comprises a digesting step of mixing at least one predetermined caustic chemical with the slurry, to digest the slurry, to form the liquified product.

10. The method according to claim 9, wherein the at least one predetermined caustic chemical is selected from one or more of: sodium hydroxide, calcium hydroxide, or potassium hydroxide.

11. The method according to claim 9, wherein the digesting step is carried out at least in part at a temperature range of 40 degrees Celsius to below 100 degrees Celsius.

12. The method according to claim 9, wherein the digesting step is carried out for twelve hours, plus or minus one hour.

13. The method according to claim 9, wherein after the digesting step, a pH of the liquified product is brought to a pH selected from a pH range of pH 6.5 to pH 8, plus or minus 0.1 pH.

14. The method according to claim 9, wherein after the digesting step, at least one predetermined additive is added to the liquified product to facilitate pumping of the liquified product into the distal portion of the injection disposal well.

15. The method according to claim 1, wherein the heavy metal penetrator is within a projectile portion of the at least one munition.

16. The method according to claim 1, wherein the heavy metal penetrator comprises at least some uranium.

17. The method according to claim 1, wherein at least one connecting wellbore is operatively linked between the human-made cavern and the surface of the Earth.

18. The method according to claim 1, wherein the human-made cavern is formed from under reaming operations within a portion of a connecting wellbore, wherein once the human-made cavern is formed, that connecting wellbore links the human-made cavern to the surface of the Earth.

19. The method according to claim 1, wherein after the step (d), the method further comprises a step of injecting a protective medium into the human-made cavern to form an artificial conglomerate rock, wherein the artificial conglomerate rock is comprised of the heavy metal penetrator and the protective medium.

20. The method according to claim 19, wherein after the artificial conglomerate rock is formed within the human-made cavern, the method further comprises a step of injecting a blanket material into the human-made cavern and above the artificial conglomerate rock, wherein the blanket material forms a protective layer above the artificial conglomerate rock.

21. The method according to claim 1, wherein after the step (d), the method further comprises a step of sealing off the human-made cavern with the heavy metal penetrator.

22. The method according to claim 21, wherein the step of sealing off the human-made cavern comprises forming or inserting one or more of: a first plug at a top of the human-made cavern; a first packer at the top of the human-made cavern; a second plug at a location in a connecting wellbore, wherein the connecting wellbore is linked to the human-made cavern; a second packer at the location in the connecting wellbore; a third plug located within the connecting wellbore; a fourth plug located a top of the connecting wellbore, wherein the top of the connecting wellbore is disposed away from the human-made cavern; or a third packer located at the top of the connecting wellbore.

23. The method according to claim 1, wherein after the step (d), the method further comprises at least one or more of: shutting down, marking a location, or protecting that human-made cavern and a connecting wellbore that is linked to that human-made cavern.

* * * * *